US008671690B2

(12) United States Patent
Ishizaka et al.

(10) Patent No.: US 8,671,690 B2
(45) Date of Patent: Mar. 18, 2014

(54) COMBUSTOR OF GAS TURBINE

(75) Inventors: Koichi Ishizaka, Takasago (JP); Eisaku Ito, Takasago (JP); Satoshi Tanimura, Takasago (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 1405 days.

(21) Appl. No.: 11/666,414

(22) PCT Filed: Jun. 2, 2006

(86) PCT No.: PCT/JP2006/311107
§ 371 (c)(1),
(2), (4) Date: Apr. 27, 2007

(87) PCT Pub. No.: WO2006/132152
PCT Pub. Date: Dec. 14, 2006

(65) Prior Publication Data

US 2008/0289341 A1 Nov. 27, 2008

(30) Foreign Application Priority Data

Jun. 6, 2005 (JP) ..... 2005-165188

(51) Int. Cl.
*F02C 7/228* (2006.01)
*F23R 3/28* (2006.01)
*F23R 3/14* (2006.01)

(52) U.S. Cl.
USPC ..... 60/734; 60/748; 60/737; 60/739

(58) Field of Classification Search
USPC ..... 60/734, 739, 737, 748, 747
See application file for complete search history.

(56) References Cited

U.S. PATENT DOCUMENTS 4,716,719 A 1/1988 Takahashi et al.
4,854,127 A 8/1989 Vinson et al.

(Continued)

FOREIGN PATENT DOCUMENTS

DE 3820962 A1 1/1989
DE 3830185 A1 7/1989

(Continued)

OTHER PUBLICATIONS

International Search Report of PCT/JP2006/311107, date of mailing Aug. 22, 2006.

(Continued)

*Primary Examiner* — Ted Kim
(74) *Attorney, Agent, or Firm* — Westerman, Hattori, Daniels & Adrian, LLP

(57) ABSTRACT

A combustor 500 is composed of a plurality of premixed combustion burners 100 each comprising a fuel nozzle 110 provided in a burner tube 120, the fuel nozzle 110 having a plurality of swirl vanes 130 on an outer peripheral surface thereof. Injection holes 133*a*, 133*b* are formed in each swirl vane 130. Staging control is exercised such that when a gas turbine is in a full load state, a fuel is injected through the injection holes 133*a*, 133*b* of all the swirl vanes 130, and when the gas turbine is under a partial load, the fuel is injected only through the injection holes 133*a*, 133*b* of a specific number of the swirl vanes 130 adjacent in a circumferential direction, and fuel injection through the injection holes 133*a*, 133*b* of the remaining swirl vanes 130 is stopped. By performing such staging control over fuel injection or its stoppage for the swirl vanes 130, a fuel-air ratio can be increased locally, generation of CO and UHC can be suppressed, and high efficiency combustion can be achieved, even under the partial load.

8 Claims, 11 Drawing Sheets

(56) References Cited

U.S. PATENT DOCUMENTS

| | | | | |
|---|---|---|---|---|
| 4,903,478 | A | 2/1990 | Seto et al. | |
| 5,511,375 | A | 4/1996 | Joshi et al. | |
| 5,533,329 | A * | 7/1996 | Ohyama et al. | 60/773 |
| 6,141,967 | A | 11/2000 | Angel et al. | |
| 6,250,063 | B1 | 6/2001 | Davis, Jr. et al. | |
| 6,301,899 | B1 | 10/2001 | Dean et al. | |
| 6,502,399 | B2 | 1/2003 | Mandai et al. | |
| 6,655,145 | B2 * | 12/2003 | Boardman | 60/748 |
| 6,684,641 | B2 * | 2/2004 | Moriya et al. | 60/737 |
| 6,962,055 | B2 * | 11/2005 | Chen et al. | 60/746 |
| 6,968,692 | B2 | 11/2005 | Chin et al. | |
| 6,993,916 | B2 | 2/2006 | Johnson et al. | |
| 7,137,258 | B2 * | 11/2006 | Widener | 60/748 |
| 2001/0023590 | A1 | 9/2001 | Mandai et al. | |
| 2003/0106321 | A1 * | 6/2003 | Von Der Bank | 60/737 |
| 2007/0028618 | A1 | 2/2007 | Hsiao et al. | |
| 2007/0289305 | A1 | 12/2007 | Oda et al. | |
| 2008/0289341 | A1 | 11/2008 | Ishizaka et al. | |
| 2010/0050647 | A1 | 3/2010 | Goodwin | |

FOREIGN PATENT DOCUMENTS

| | | | |
|---|---|---|---|
| DE | 3819899 | C1 | 11/1989 |
| DE | 19533055 | B4 | 3/1996 |
| EP | 0198502 | A1 | 10/1986 |
| EP | 0974789 | A1 | 1/2000 |
| EP | 1077349 | A1 | 2/2001 |
| JP | 63-104816 | U | 7/1988 |
| JP | 2-100060 | U | 8/1990 |
| JP | 5-272711 | A | 10/1993 |
| JP | 8-210641 | A | 8/1996 |
| JP | 10-185185 | A | 7/1998 |
| JP | 11-14055 | A | 1/1999 |
| JP | 11-83016 | A | 3/1999 |
| JP | 11-337068 | A | 12/1999 |
| JP | 11-83016 | A | 10/2000 |
| JP | 2001-073804 | A | 3/2001 |
| JP | 2001-73804 | A | 3/2001 |
| JP | 2004-12039 | A | 1/2004 |

OTHER PUBLICATIONS

German Office Action dated Apr. 17, 2008, issued in corresponding German Patent Application No. 11 2006 001 317.3-13 with English translation.

German Office Action dated Aug. 3, 2009, issued in corresponding German Patent Application No. 11 2006 001 317.3.

Chinese Office Action dated Feb. 6, 2009, issued in corresponding Chinese Patent Application No. 200680001290.5.

* cited by examiner

COMBUSTOR OF GAS TURBINE

TECHNICAL FIELD

This invention relates to a combustor of a gas turbine. The present invention adopts features capable of realizing novel staging control, and is thereby contrived to enable a gas turbine to perform a high efficiency operation while decreasing carbon monoxide (CO) and an unburned fuel (UHC: unburned hydrocarbon) contained in an exhaust gas, even when the gas turbine is operated under a light load.

BACKGROUND ART

A gas turbine used in power generation, etc. is composed of a compressor, a combustor, and a turbine as main members. The gas turbine often has a plurality of combustors, and mixes air, which is compressed by the compressor, with a fuel supplied to the combustors, and burns the mixture in each combustor to generate a high temperature combustion gas. This high temperature combustion gas is supplied to the turbine to drive the turbine rotationally.

An example of the combustor of a conventional gas turbine will be described with reference to FIG. 12.

As shown in FIG. 12, a plurality of combustors 10 of this gas turbine are arranged annularly in a combustor casing 11 (only one combustor is shown in FIG. 12). The combustor casing 11 and a gas turbine casing 12 are full of compressed air to form a casing 13. Air, which has been compressed by a compressor, is introduced into this casing 13. The introduced compressed air enters the interior of the combustor 10 through an air inlet 14 provided in an upstream portion of the combustor 10. In the interior of an inner tube 15 of the combustor 10, a fuel supplied from a fuel nozzle 16 and compressed air are mixed and burned. A combustion gas produced by combustion is passed through a transition pipe 17, and supplied toward a turbine room to rotate a turbine rotor.

FIG. 13 is a perspective view showing the fuel nozzle 16, the inner tube 15, and the transition pipe 17 in a separated state. As shown in this drawing, the fuel nozzle 16 has a plurality of premixing fuel nozzles 16*a*, and one pilot fuel nozzle 16*b*. A plurality of swirlers 18 are provided in the inner tube 15. The plurality of premixing fuel nozzles 16*a* penetrate the swirlers 18, and are then inserted into the inner tube 15.

Thus, the fuel injected from the premixing fuel nozzles 16*a* is premixed with air, which has been converted to a swirl flow by the swirlers 18, and is burned within the inner tube 15.

The example of FIGS. 12 and 13 is of the type in which the fuel nozzle 16 is inserted into the swirlers 18 provided in the inner tube 15. However, there is also a combustor of the type in which a plurality of swirlers (swirl vanes) are provided on the outer peripheral surface of a fuel nozzle, and a fuel is injected from the swirlers.

With the combustor of the type having the plurality of swirlers (swirl vanes) provided on the outer peripheral surface of the fuel nozzle, lean premixed combustion is adopted as a technique for raising the efficiency of the gas turbine while decreasing the generation of CO and UHC. If such lean premixed combustion is employed, the mixture ratio of fuel and air (fuel-air ratio: F/A) has to be maintained in "a specific range" in order to suppress the generation of CO and the generation of UHC at the same time.

Patent Document 1: Japanese Unexamined Patent Publication No. 1999-14055

Patent Document 2: Japanese Unexamined Patent Publication No. 2004-12039

DISCLOSURE OF THE INVENTION

Problems to be Solved by the Invention

With the gas turbine equipped with the combustor of the type having the plurality of swirlers (swirl vanes) provided on the outer peripheral surface of the fuel nozzle, the amount of the fuel supplied to the combustor is decreased, if load diminishes, and a partial load results. Even if such a partial load results, customary practice has been to inject the fuel from all of the swirl vanes provided on the outer peripheral surface of the fuel nozzle of the combustor to operate combustion. Thus, the fuel-air ratio F/A of the combustor may become so low as to deviate from the aforementioned "specific range".

Under the partial load, as described above, the conventional technologies may render the fuel-air ratio F/A too low. In this case, the amounts of CO and UHC generated increase. Since the fuel-air ratio F/A is low, namely, the fuel concentration is low, moreover, combustion efficiency decreases.

The present invention has been accomplished in the light of the above-described conventional technologies. It is an object of the invention to provide a combustor of a gas turbine of the type having a plurality of swirlers (swirl vanes) provided on the outer peripheral surface of a fuel nozzle, the combustor being capable of performing a high efficiency operation while decreasing carbon monoxide (CO) and an unburned fuel (UHC: unburned hydrocarbon) contained in an exhaust gas, even when the gas turbine is operated under a light load.

Means for Solving the Problems

A constitution of the present invention for solving the above problems is a combustor of a gas turbine, the combustor having a combustion burner comprising:

a fuel nozzle; and swirl vanes which are arranged at a plurality of locations along a circumferential direction of an outer peripheral surface of the fuel nozzle in such a state as to extend along an axial direction of the fuel nozzle, and which progressively curve from an upstream side toward a downstream side of a flow of air flowing along the axial direction of the fuel nozzle in order to swirl the air around the fuel nozzle, characterized in that the combustor comprises:

injection holes formed in each swirl vane for injecting a fuel;

fuel passages for supplying the fuel individually to the injection holes formed in each swirl vane;

valves provided in the respective fuel passages; and a control section for controlling the valves to open or close, and the control section brings all of the valves to an open state when the gas turbine is in a full load state, and controls an opening of particular valves of the valves in accordance with a load, and closes remaining valves of the valves, when the gas turbine is in a partial load state.

Another constitution of the present invention is a combustor of a gas turbine, the combustor having a combustion burner comprising:

a fuel nozzle; and swirl vanes which are arranged at a plurality of locations along a circumferential direction of an outer peripheral surface of the fuel nozzle in such a state as to extend along an axial direction of the fuel nozzle, and which progressively curve from an upstream side toward a downstream side of a flow of air flowing along the axial direction of the fuel nozzle in order to swirl the air around the fuel nozzle, characterized in that the combustor comprises:

injection holes formed in each swirl vane for injecting a fuel;

fuel passages for supplying the fuel individually to the injection holes formed in each swirl vane;

valves provided in the respective fuel passages; and a control section for controlling the valves to open or close, and the control section brings all of the valves to an open state when the gas turbine is in a full load state, and controls an opening of the valves, which are provided in the fuel passages for supplying the fuel to the injection holes formed in a specific number of the swirl vanes arranged adjacently in the circumferential direction, in accordance with a load, and closes remaining valves of the valves, when the gas turbine is in a partial load state.

Another constitution of the present invention is a combustor of a gas turbine, the combustor having a plurality of combustion burners each comprising:

a fuel nozzle; and swirl vanes which are arranged at a plurality of locations along a circumferential direction of an outer peripheral surface of the fuel nozzle in such a state as to extend along an axial direction of the fuel nozzle, and which progressively curve from an upstream side toward a downstream side of a flow of air flowing along the axial direction of the fuel nozzle in order to swirl the air around the fuel nozzle, characterized in that the combustor comprises:

injection holes on an inner peripheral side and injection holes on an outer peripheral side which are formed on an inner peripheral side and an outer peripheral side of each swirl vane for injecting a fuel;

fuel passages for supplying the fuel individually to the injection holes on the inner peripheral side and the injection holes on the outer peripheral side formed in each swirl vane;

valves provided in the respective fuel passages; and a control section for controlling the valves to open or close, and the control section exercises control over the plurality of the combustion burners in such a manner as to bring all of the valves to an open state when the gas turbine is in a full load state, and control an opening of the valves, which are provided in the fuel passages for supplying the fuel to the injection holes on the inner peripheral side, in accordance with a load, and close the valves provided in the fuel passages for supplying the fuel to the injection holes on the outer peripheral side, when the gas turbine is in a partial load state.

Another constitution of the present invention is a combustor of a gas turbine, the combustor having a plurality of combustion burners each comprising:

a fuel nozzle; and swirl vanes which are arranged at a plurality of locations along a circumferential direction of an outer peripheral surface of the fuel nozzle in such a state as to extend along an axial direction of the fuel nozzle, and which progressively curve from an upstream side toward a downstream side of a flow of air flowing along the axial direction of the fuel nozzle in order to swirl the air around the fuel nozzle, characterized in that the combustor comprises:

injection holes formed in each swirl vane for injecting a fuel, and injection holes formed in the fuel nozzle for injecting the fuel;

fuel passages for supplying the fuel individually to the injection holes formed in each swirl vane and the injection holes formed in the fuel nozzle;

valves provided in the respective fuel passages; and a control section for controlling the valves to open or close, and the control section exercises control over the plurality of the combustion burners in such a manner as to bring all of the valves to an open state when the gas turbine is in a full load state, and control an opening of the valves, which are provided in the fuel passages for supplying the fuel to the injection holes formed in the fuel nozzle, in accordance with a load, and close the valves provided in the fuel passages for supplying the fuel to the injection holes formed in the swirl vanes, when the gas turbine is in a partial load state.

Another constitution of the present invention is the above-described combustor of a gas turbine, characterized in that an angle formed by a tangent to an average camber line of the swirl vane at a rear edge of the swirl vane and an axis line extending along the axial direction of the fuel nozzle is 0 to 10 degrees on an inner peripheral side of the rear edge of the swirl vane, and the angle is larger on an outer peripheral side of the rear edge of the swirl vane than the angle on the inner peripheral side of the rear edge of the swirl vane.

Another constitution of the present invention is the above-described combustor of a gas turbine, characterized in that an angle formed by a tangent to an average camber line of the swirl vane at a rear edge of the swirl vane and an axis line extending along the axial direction of the fuel nozzle is 0 to 10 degrees on an inner peripheral side of the rear edge of the swirl vane, and is 25 to 35 degrees on an outer peripheral side of the rear edge of the swirl vane.

Effects of the Invention

According to the present invention, the following staging control is exercised in a combustor of a gas turbine having a combustion burner which has a plurality of swirl vanes provided on an outer peripheral surface of a fuel nozzle, and injection holes provided in each of the swirl vanes: When the gas turbine is under a partial load, a fuel is injected only through the injection holes provided in the specific swirl vanes, and no fuel is injected through the injection holes provided in the remaining swirl vanes. Thus, the fuel-air ratio is low in the entire combustion burner, but the fuel-air ratio can be raised in the vicinity of each swirl vane (namely, locally). As a result, even under the partial load, the amounts of CO and UHC generated can be cut down, and the combustion efficiency can be increased.

DESCRIPTION OF THE NUMERALS AND SYMBOLS

Figure 1:
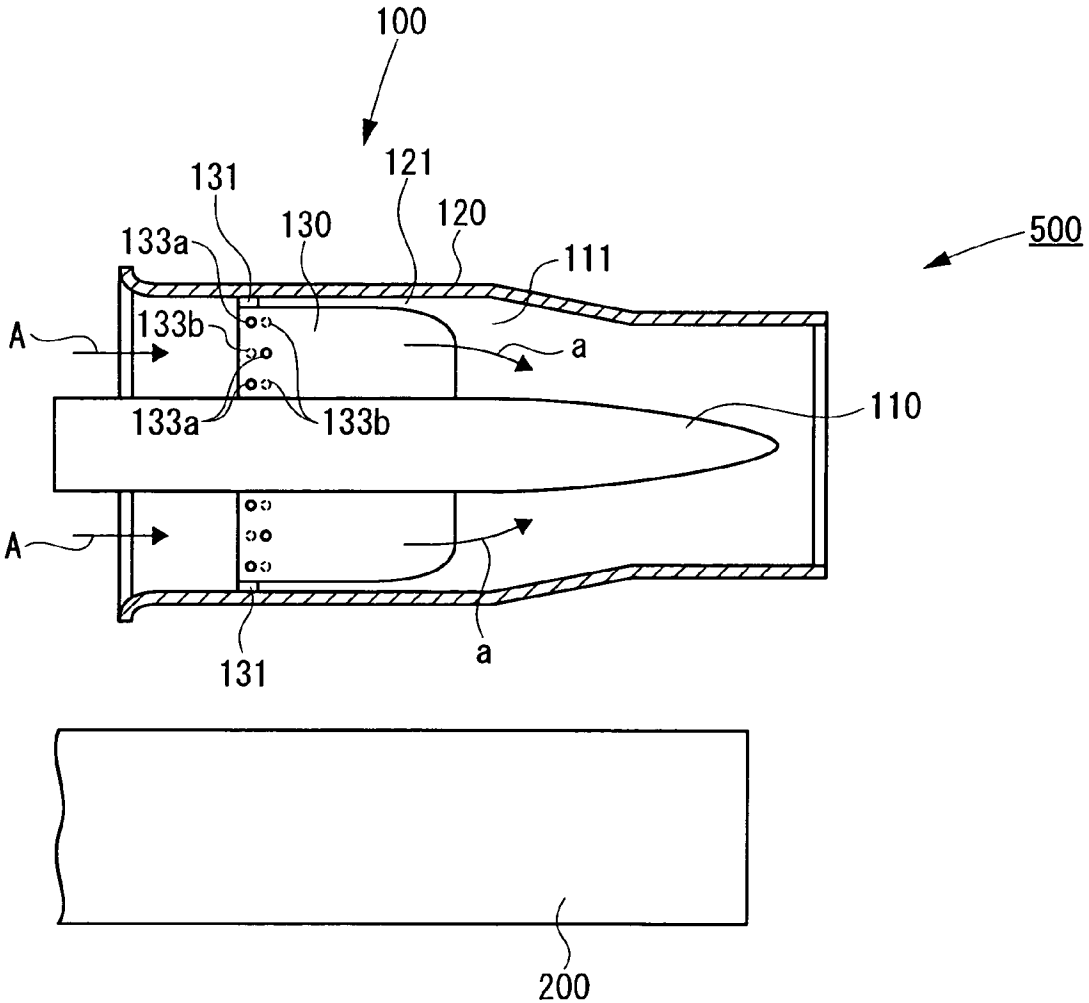
FIG. 1 is a configurational drawing showing a combustor of a gas turbine according to Embodiment 1 of the present invention.

100, 100A to 100H Premixed combustion burner
110 Fuel nozzle
111 Air passage
120 Burner tube
121 Clearance
130 Swirl tube
131 Clearance setting rib
132*a* Vane ventral surface
132*b* Vane dorsal surface
133*a*, 133*b*, 133*c*, 133*d* Injection hole
200 Pilot combustion burner
300A1 to 300A6, 300B1 to 300B6, 300C1 to 300C6, 300D1 to 300D6, 300E1 to 300E6, 300F1 to 300F6, 300G1 to 300G6, 300H1 to 300H6, 300*c*, 300*d* Valve
310, 320 Control section
500, 520 Combustor
L, LA1 to LA6, LB1 to LB6, LC1 to LC6, LD1 to LD6, LE1 to LE6, LF1 to LF6, LG1 to LG6, LH1 to LH6 Fuel passage
A Compressed air
a Swirl air flow
u Vortex air flow

BEST MODE FOR CARRYING OUT THE INVENTION

Embodiments of the present invention will now be described in detail based on the Embodiments shown below.

The inventor of the present application developed a premixed combustion burner of a gas turbine having novel features, the burner having swirl vanes (swirler vanes) provided on the outer peripheral surface of a fuel nozzle. The developed novel premixed combustion burner can thoroughly mix a fuel to form a fuel gas of a uniform concentration, and can uniformize the flow velocity of the fuel gas to prevent backfire reliably.

The following Embodiments explain examples in which the present invention is applied to combustors adopting the novel premixed combustion burner.

Embodiment 1

<Overall Configuration of Embodiment 1>

As shown in FIG. 1, in a combustor 500 of a gas turbine according to Embodiment 1 of the present invention, a plurality of (for example, eight) premixed combustion burners 100 are arranged to surround the periphery of a pilot combustion burner 200. A pilot combustion nozzle, although not shown, is built into the pilot combustion burner 200.

The plurality of (for example, eight) premixed combustion burners 100 arranged parallel in the circumferential direction, and one pilot combustion burner 200 make up one combustor 500, and a plurality of the combustors 500 thus constituted are installed in the gas turbine.

The premixed combustion burner 100 is composed of a fuel nozzle 110, a burner tube 120, and a swirl vane (swirler vane) 130 as main members.

The burner tube 120 is disposed to be concentric with the fuel nozzle 110 and to encircle the fuel nozzle 110. Thus, a ring-shaped air passage 111 is formed between the outer peripheral surface of the fuel nozzle 110 and the inner peripheral surface of the burner tube 120.

Compressed air A flows through the air passage 111 from its upstream side (left-hand side in FIG. 1) toward its downstream side (right-hand side in FIG. 1).

Figure 2:
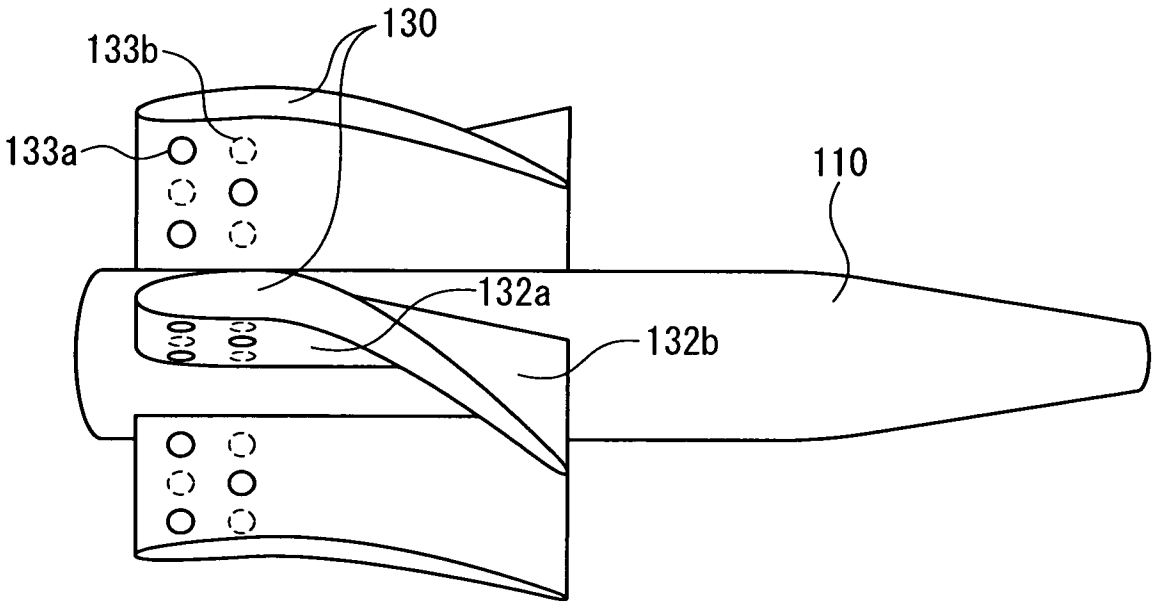
FIG. 2 is a perspective view showing a fuel nozzle and swirl vanes of a premixed combustion burner provided in the combustor according to Embodiment 1.
Figure 3:
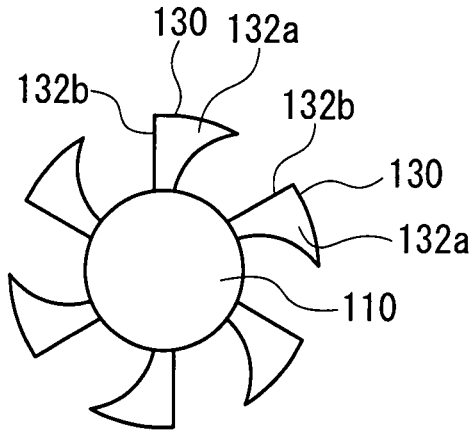
FIG. 3 is a configurational drawing showing, from an upstream side, the fuel nozzle and swirl vanes of the premixed combustion burner provided in the combustor according to Embodiment 1.
Figure 4:
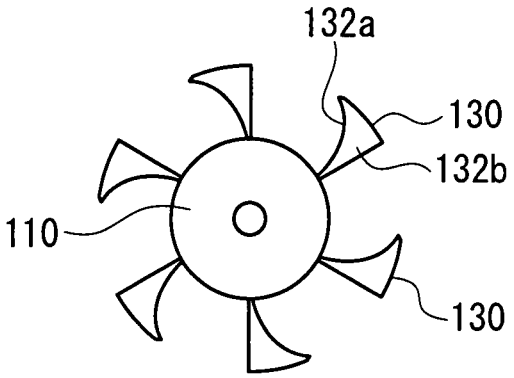
FIG. 4 is a configurational drawing showing, from a downstream side, the fuel nozzle and swirl vanes of the premixed combustion burner provided in the combustor according to Embodiment 1.

As shown in FIG. 1, FIG. 2 as a perspective view, FIG. 3 viewed from the upstream side, and FIG. 4 viewed from the downstream side, the swirl vanes 130 are arranged at a plurality of locations (six locations in the present embodiment) along the circumferential direction of the fuel nozzle 110, and extend along the axial direction of the fuel nozzle 110.

In FIG. 1, only two of the swirl vanes 130 arranged at an angle of 0 degree and an angle of 180 degrees along the circumferential direction are shown to facilitate understanding (in the state of FIG. 1, a total of the four swirl vanes are seen actually).

Each swirl vane 130 is designed to impart a swirling force to the compressed air A flowing through the air passage 111, thereby converting the compressed air A into a swirl air flow a. For this purpose, each swirl vane 130 gradually curves from its upstream side toward its downstream side (inclines along the circumferential direction) so as to be capable of swirling the compressed air A. Details of the curved state of the swirl vane 130 will be described later.

A clearance (gap) 121 is provided between the outer peripheral side end surface (tip) of each swirl vane 130 and the inner peripheral surface of the burner tube 120.

Further, a clearance setting rib 131 is fixed to a front edge side of the outer peripheral side end surface (tip) of each swirl vane 130. Each clearance setting rib 131 has such a height (diametrical length) as to make intimate contact with the inner peripheral surface of the burner tube 120 when the fuel nozzle 110 equipped with the swirl vanes 130 is assembled to the interior of the burner tube 120.

Thus, the length (diametrical length) of each clearance 121 formed between each swirl vane 130 and the burner tube 120 is equal. Also, it becomes easy to perform an assembly operation for assembling the fuel nozzle 110 equipped with the swirl vanes 130 to the interior of the burner tube 120.

Injection holes 133*b* (indicated by dashed-line circles in FIGS. 1 and 2) are formed in the vane dorsal surface 132*b* of each swirl vane 130, and injection holes 133*a* (indicated by solid-line circles in FIGS. 1 and 2) are formed in the vane ventral surface 132*a* of each swirl vane 130. In this case, the positions of formation of the injection holes 133*b* and the injection holes 133*a* are in a staggered arrangement.

Thus, when the adjacent swirl vanes 131 are observed, the position of the injection hole 133*a* formed in the vane ventral surface 132*a* of one of the adjacent swirl vanes 131 and the position of the injection hole 133*b* formed in the vane dorsal surface 132*b* of the other of the adjacent swirl vanes 131 are positionally displaced.

Fuel passages, although not shown, are formed within the fuel nozzle 110 and each swirl vane 130, and a fuel is supplied to the respective injection holes 133*a*, 133*b* via the fuel passages of the fuel nozzle 110 and the fuel passages of each swirl vane 130.

Thus, the fuel is injected through the respective injection holes 133*a*, 133*b* toward the air passage 111. At this time, the position of arrangement of the injection hole 133*a* and the position of arrangement of the injection hole 133*b* are positionally displaced, so that the fuel injected through the injection hole 133*a* and the fuel injected through the injection hole 133*b* do not interfere (collide).

The injected fuel is mixed with the air A (a) to form a fuel gas, which is fed to the internal space of an inner tube for combustion.

The state of arrangement of the fuel passages, and a technique for staging control, which are the technical points of the present embodiment, will be described later.

Here, the curved state of the swirl vane 130 will be described with reference to FIGS. 1 to 4.

(1) Briefly, each swirl vane 130 progressively curves from its upstream side toward its downstream side so as to be capable of swirling the compressed air A.

(2) As far as the axial direction (longitudinal direction of the fuel nozzle 110) is concerned, the curvature increases farther from the upstream side and nearer to the downstream side.

(3) At the rear edge of the swirl vane 130, the curvature increases toward the outer peripheral side, as compared with the inner peripheral side, with respect to the diametrical direction (radial direction (direction of radiation) of the fuel nozzle 110).

The above-described curvature at the rear edge of the swirl vane 130 in (3) will be further described with reference to FIG. 5.

Figure 5:
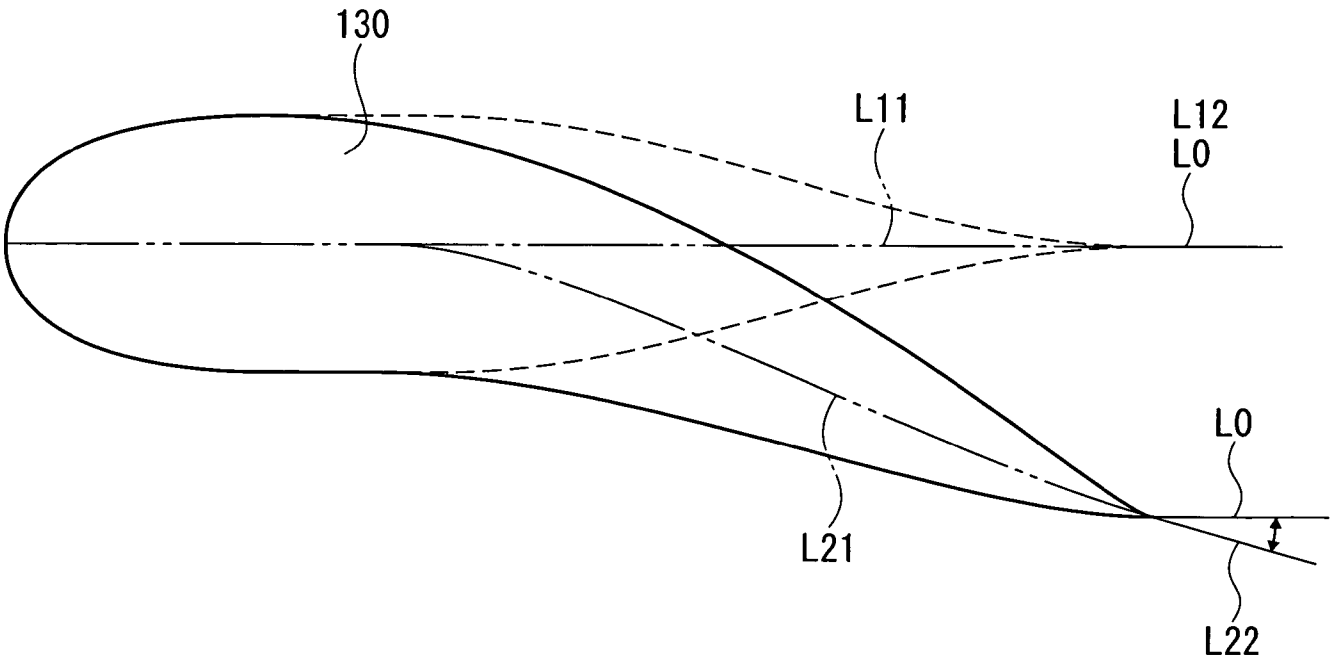
FIG. 5 is an explanation drawing showing the curved state of the swirl vane.

In FIG. 5, dashed lines represent the vane profile (vane sectional shape) on the inner peripheral side (innermost peripheral surface) of the swirl vane 130, while solid lines represent the vane profile (vane sectional shape) on the outer peripheral side (outermost peripheral surface) of the swirl vane 130.

In the vane profile on the inner peripheral side indicated by the dashed lines, an average camber line (skeletal line) is designated as L11, and a tangent to the average camber line L11 at the rear edge of the swirl vane is designated as L12.

In the vane profile on the outer peripheral side indicated by the solid lines, an average camber line (skeletal line) is designated as L21, and a tangent to the average camber line L21 at the rear edge of the swirl vane is designated as L22.

An axis line along the axial direction of the fuel nozzle 110 is designated as L0.

According to the present embodiment, as shown in FIG. 5, at the rear edge of the swirl vane 130, an angle formed by the tangent L12 on the inner peripheral side and the axis line L0 is set at 0 degree, and an angle formed by the tangent L22 on the outer peripheral side and the axis line L0 is set to be larger than the angle on the inner peripheral side.

According to studies by the inventor, when the angle formed by the axis line and the tangent to the average camber line at the rear edge of the swirl vane is increased from the inner peripheral side toward the outer peripheral side, it has been found "optimal"

(a) to set the angle on the inner peripheral side at 0 to 10 degrees, and (b) to set the angle on the outer peripheral side at 25 to 35 degrees.

Here, the term "optimal" means (i) that whether on the inner peripheral side or on the outer peripheral side of the air passage 111, the flow velocity of the air A (a) becomes uniform, and the occurrence of flashback (backfire) can be prevented, and (ii) that whether on the inner peripheral side or on the outer peripheral side of the air passage 111, the fuel concentration becomes uniform.

The reason for (i) will be described.

Assume that the angle formed by the tangent to the average camber line and the axis line on the inner peripheral side is set to be equal to that on the outer peripheral side. In this case, a streamline (air flow) heading from the inner peripheral side toward the outer peripheral side is generated. As a result, the flow velocity of the air A (a) passing on the inner peripheral side of the air passage 111 (passing along the axial direction) becomes low, while the flow velocity of the air A (a) passing on the outer peripheral side of the air passage 111 (passing along the axial direction) becomes high. If the air flow velocity on the inner peripheral side is decreased in this manner, flashback is likely to occur on the inner peripheral side.

In the present invention, however, the angle formed by the tangent to the average camber line and the axis line increases from the inner peripheral side toward the outer peripheral side. Thus, the occurrence of the streamline heading from the inner peripheral side toward the outer peripheral side can be suppressed. Whether on the inner peripheral side or on the outer peripheral side of the air passage 111, therefore, the flow velocity of the air A (a) becomes uniform, and can prevent the occurrence of flashback (backfire).

The reason for (ii) above will be described.

The circumferential length of the air passage 111 is short on the inner peripheral side, and long on the outer peripheral side. In the present invention, the angle formed by the tangent to the average camber line and the axis line increases from the inner peripheral side toward the outer peripheral side. Thus, the force (effect) imparting swirl to the compressed air A is stronger on the outer peripheral side with the larger circumferential length than on the inner peripheral side with the smaller circumferential length. As a result, the force imparting swirl to the compressed air A is uniform, per unit length, not only on the inner peripheral side but also on the outer peripheral side. Thus, the fuel concentration is uniform on the outer peripheral side as well as on the inner peripheral side.

Furthermore, the reason why the angle formed by the axis line and the tangent to the average camber line at the rear edge of the swirl vane is (a) set at 0 to 10 degrees as the angle on the inner peripheral side, and (b) set at 25 to 35 degrees as the angle on the outer peripheral side will be explained with reference to FIGS. 6 and 7 which are characteristic views showing the results of experiments. The "angles" shown in FIGS. 6 and 7 are angles formed by the axis line and the tangent to the average camber line at the rear edge of the swirl vane.

Figure 6:
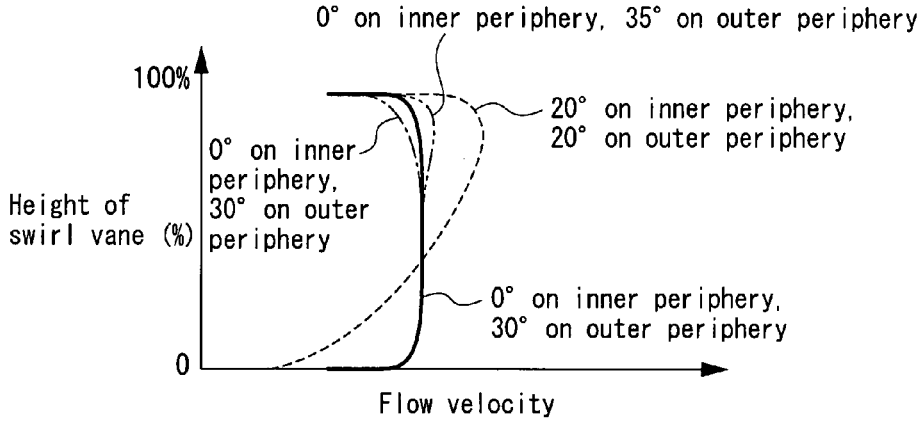
FIG. 6 is a characteristic view showing the relationship between the height of the swirl vane and the flow velocity of air.

FIG. 6 is a characteristic view in which the ordinate represents the height (%) of the swirl vane 130 and the abscissa represents the flow velocity of the air A (a). The height of the swirl vane of 100% means the outermost peripheral position of the swirl vane, and the height of the swirl vane of 0% means the innermost peripheral position of the swirl vane.

FIG. 6 shows a characteristic with the angle on the inner peripheral side of 0 degree and the angle on the outer peripheral side of 5 degrees, a characteristic with the angle on the inner peripheral side of 0 degree and the angle on the outer peripheral side of 30 degrees, a characteristic with the angle on the inner peripheral side of 0 degree and the angle on the outer peripheral side of 35 degrees, and a characteristic with the angle on the inner peripheral side of 20 degrees and the angle on the outer peripheral side of 20 degrees.

Figure 7:
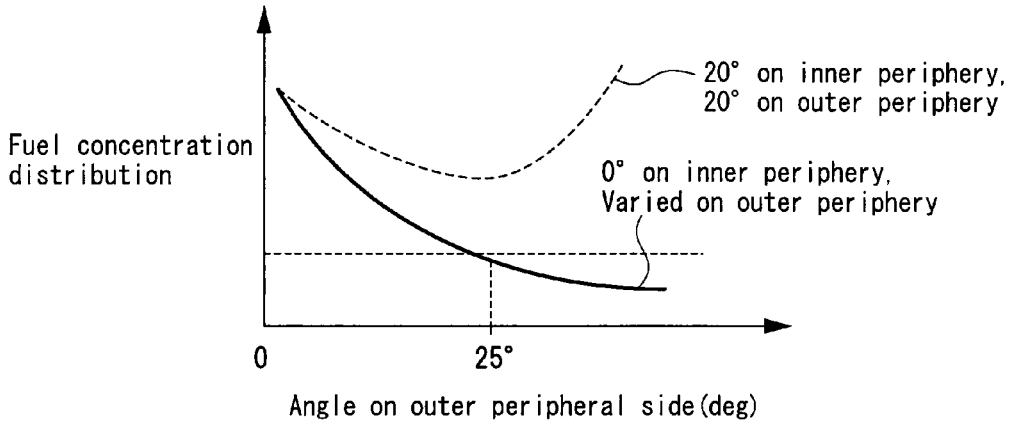
FIG. 7 is a characteristic view showing the relationship between the fuel concentration distribution and the angle on the outer peripheral side of the swirl vane.

FIG. 7 is a characteristic view in which the fuel concentration distribution is plotted as the ordinate and the angle on the outer peripheral side is plotted as the abscissa. The fuel concentration distribution refers to the difference between the maximum fuel concentration and the minimum fuel concentration, and a smaller value of the fuel concentration distribution means that the concentration is constant.

FIG. 7 shows a characteristic with the angle on the inner peripheral side of 20 degrees and the angle on the outer peripheral side of 20 degrees, and a characteristic with the angle on the inner peripheral side of 0 degree and the angle on the outer peripheral side of varying degree.

As seen from FIG. 7 showing the fuel concentration distribution, the fuel concentration becomes uniform when the angle on the outer peripheral side becomes 25 degrees or more.

As seen from FIG. 6, moreover, it is at the angle on the inner peripheral side of 0 to 10 degrees and at the angle on the outer peripheral side of 25 to 35 degrees that the distribution, in the vane height direction, of the flow velocity is uniformized at the angle on the outer peripheral side of 25 degrees or more.

As note above, the characteristics in FIGS. 6 and 7 show that (a) by setting the angle on the inner peripheral side at 0 to 10 degrees, and (b) by setting the angle on the outer peripheral side at 25 to 35 degrees, (i) whether on the inner peripheral side or on the outer peripheral side of the air passage 111, the flow velocity of the air A (a) becomes uniform, and can prevent the occurrence of flashback (backfire), and (ii) whether on the inner peripheral side or on the outer peripheral side of the air passage 111, the fuel concentration can be uniformized.

In the present embodiment, as stated above, the clearance (gap) 121 is intentionally provided between the outer peripheral side end surface (tip) of each swirl vane 130 and the inner peripheral surface of the burner tube 120.

The vane dorsal surface 132*b* of the swirl vane 130 is under negative pressure, while the vane ventral surface 132*a* of the swirl vane 130 is under positive pressure, so that there is a pressure difference between the vane dorsal surface 132 band the vane ventral surface 132*a*. Thus, a leakage flow of air is produced which passes through the clearance 121 and goes around from the vane ventral surface 132*a* to the vane dorsal surface 132*b*. This leakage flow, and the compressed air A flowing through the air passage 111 in the axial direction act to produce a vortex air flow. This vortex air flow mixes the fuel injected through the injection holes 133*a*, 133*b* and air more effectively, thereby promoting the uniformization of the fuel gas.

<State of Arrangement of Fuel Passages and Staging Control Method in Embodiment 1>

Next, an explanation will be offered for the state of arrangement of the fuel passages and the staging control method in the present Embodiment 1.

Figure 8:
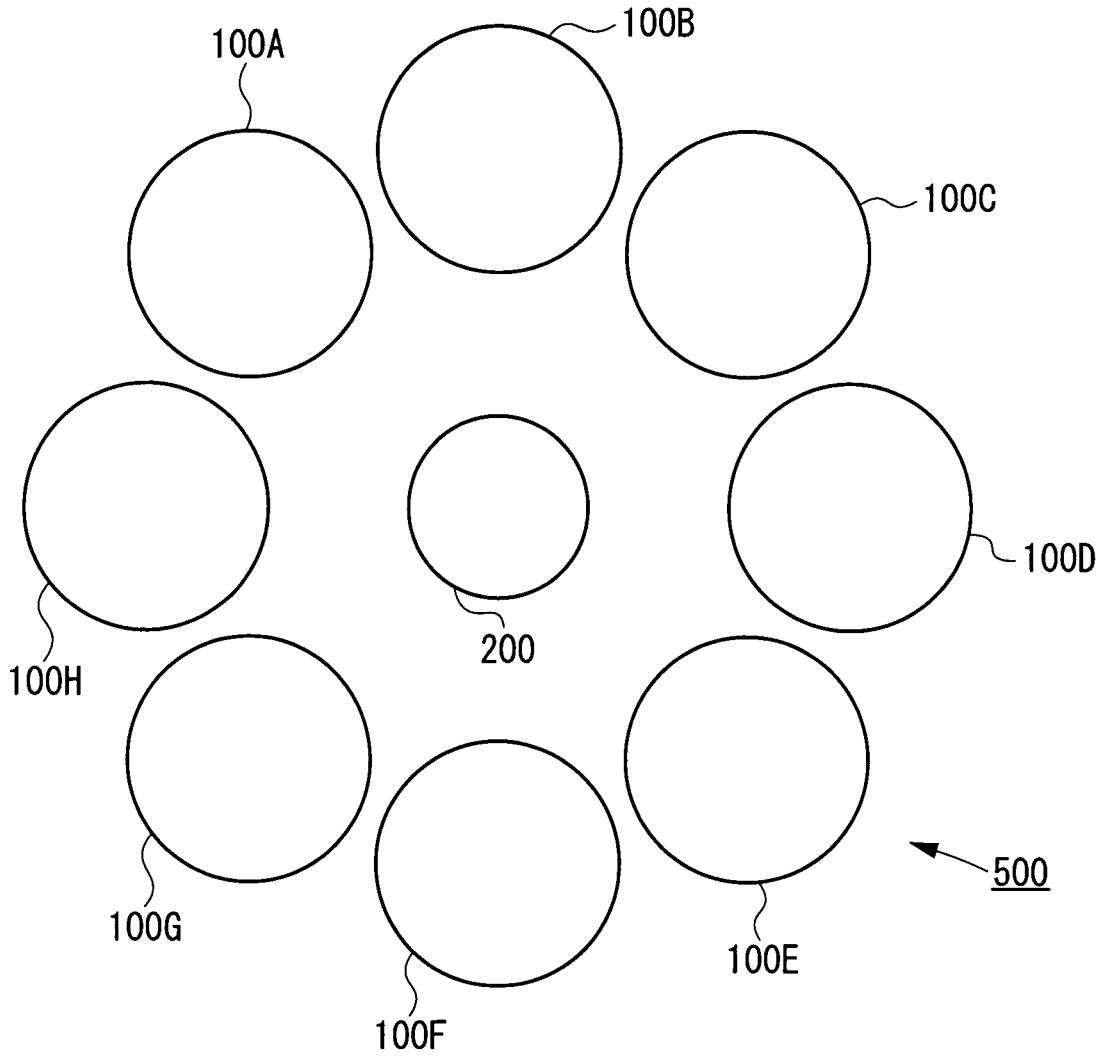
FIG. 8 is a configurational drawing showing the state of arrangement of the combustor according to Embodiment 1 of the present invention.

In the combustor 500 of the gas turbine of the present Embodiment 1, as shown in FIG. 8, a plurality of (eight of) the premixed combustion burners 100 are arranged parallel in the circumferential direction to surround the periphery of the one pilot combustion burner 200.

In the following descriptions, 100A, 100B, 100C, 100D, 100E, 100F, 100G, 100H are used as symbols for distinguishing among the individual premixed combustion burners, and 100 is used as a numeral when each premixed combustion burner is shown without distinction.

Each of the premixed combustion burners 100A to 100H has six of the swirl vanes 130. The injection holes 130*a*, 130*b* are formed in each swirl vane 130.

Here, each swirl vane is shown in a distinguished manner by (a) designating the six swirl vanes, provided in the premixed combustion burner 100A, by the symbols 130A1, 130A2, 130A3, 130A4, 130A5, 130A6, (b) designating the six swirl vanes, provided in the premixed combustion burner 100B, by the symbols 130B1, 130B2, 130B3, 130B4, 130B5, 130B6, (c) designating the six swirl vanes, provided in the premixed combustion burner 100C, by the symbols 130C1, 130C2, 130C3, 130C4, 130C5, 130C6, (d) designating the six swirl vanes, provided in the premixed combustion burner 100D, by the symbols 130D1, 130D2, 130D3, 130D4, 130D5, 130D6, (e) designating the six swirl vanes, provided in the premixed combustion burner 100E, by the symbols 130E1, 130E2, 130E3, 130E4, 130E5, 130E6, (f) designating the six swirl vanes, provided in the premixed combustion burner 100F, by the symbols 130F1, 130F2, 130F3, 130F4, 130F5, 130F6, (g) designating the six swirl vanes, provided in the premixed combustion burner 100G, by the symbols 130G1, 130G2, 130G3, 130G4, 130G5, 130G6, and (h) designating the six swirl vanes, provided in the premixed combustion burner 100H, by the symbols 130H1, 130H2, 130H3, 130H4, 130H5, 130H6.

If each swirl vane is shown without distinction, the numeral 130 is used.

Figure 9:
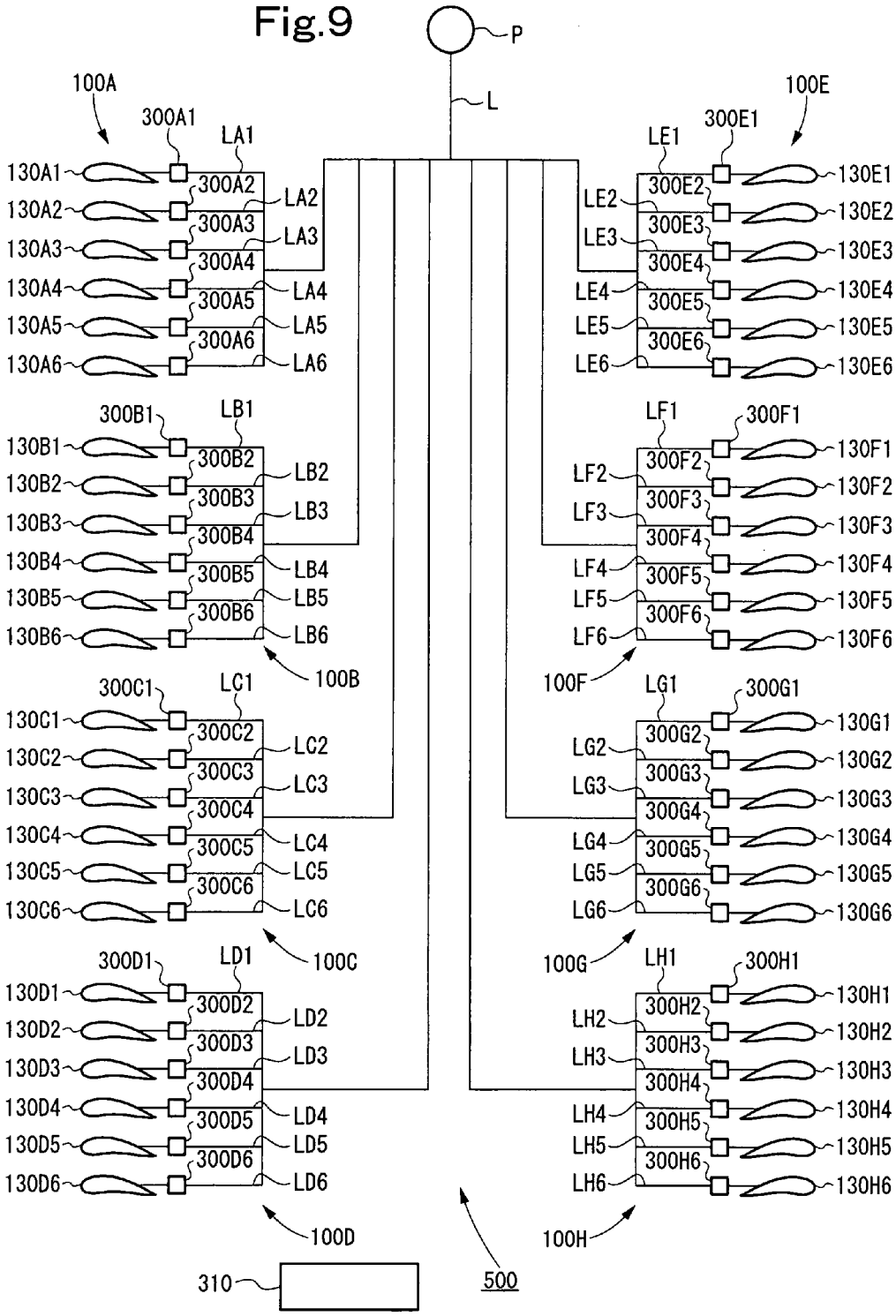
FIG. 9 is a system diagram showing a piping layout system in the combustor according to Embodiment 1 of the present invention.

The fuel passage system in the present Embodiment 1 is shown in FIG. 9 which is a schematic system diagram. As shown in FIG. 9, the fuel supplied from a fuel pump P is supplied to the injection holes 133*a*, 133*b* of the individual swirl vane 130 via a fuel passage L branching off from the fuel pump P.

Fuel supply is performed to the pilot combustion burner 200 as well, but a fuel passage for supplying the fuel to the pilot combustion burner 200 is not shown.

Respective fuel passages LA1 to LA6, LB1 to LB6, LC1 to LC6, LD1 to LD6, LE1 to LE6, LF1 to LF6, LG1 to LG6, and LH1 to LH6, which have been branched off in order to supply the fuel individually to the respective swirl vanes 130A1 to 130A6, 130B1 to 130B6, 130C1 to 130C6, 130D1 to 130D6, 130E1 to 130E6, 130F1 to 130F6, 130G1 to 130G6, and 130H1 to 130H6, each having the injection holes 133*a*, 133*b*, are provided with valves 300A1 to 300A6, 300B1 to 300B6, 300C1 to 300C6, 300D1 to 300D6, 300E1 to 300E6, 300F1 to 300F6, 300G1 to 300G6, and 300H1 to 300H6, respectively.

If each valve is shown without distinction, the numeral 300 is used.

A control section 310 adjusts the opening of the respective valves 300A1 to 300A6, 300B1 to 300B6, 300C1 to 300C6, 300D1 to 300D6, 300E1 to 300E6, 300F1 to 300F6, 300G1 to 300G6, and 300H1 to 300H6 in response to the load on the gas turbine, thereby controlling the amount of the fuel supplied to the respective swirl vanes 130A1 to 130A6, 130B1 to 130B6, 130C1 to 130C6, 130D1 to 130D6, 130E1 to 130E6, 130F1 to 130F6, 130G1 to 130G6, and 130H1 to 130H6.

The control section 310 makes opening and closing (opening or the degree of opening) adjustment of each valve 300, for example, in the following manner in accordance with the load on the gas turbine.

If the load on the gas turbine is a full load, the control section 310 brings all of the valves 300 to an open state. By so doing, the fuel is injected through the injection holes 133*a*, 133*b* of all the swirl vanes 130.

If the load on the gas turbine becomes a partial load, the control section 310 exercises control over the premixed combustion burner 100A such that the valves 300A1 to 300A3 are opened, and their opening is adjusted according to the amount of the load, while the valves 300A4 to 300A6 are closed. By such control, the fuel is injected through the injection holes 133*a*, 133*b* of the swirl vanes 130A1 to 130A3. Here, the swirl vanes 130A1 to 130A3 are the swirl vanes adjacent parallel in the circumferential direction.

Furthermore, each swirl vane 130 is swiveling. Thus, the swirl air flow a (see FIG. 1) is roughly divided into a flow wrapping up toward the inner peripheral side (toward the center in the radial direction), and a flow wrapping up toward the outer peripheral side (toward the outer periphery in the radial direction) The swirl vanes 130A1 to 130A3 are the swirl vanes arranged at portions where the swirl air flow a wrapping up toward the inner peripheral side flows.

As described above, the fuel is not injected from all the swirl vanes 130, but the fuel is injected only from the particular swirl vanes 130A1 to 130A3. Thus, in the entire premixed combustion burner 100A, the fuel-air ratio F/A is low. However, if viewed for the respective swirl vanes 130A1 to 130A3, namely, if viewed locally, the fuel-air ratio F/A is high. Moreover, the respective swirl vanes 130A1 to 130A3 are adjacent in the circumferential direction (i.e., they are present in a group). Thus, the proportion in which the fuel injected from the swirl vanes 130A1 to 130A3 is diffused by and mixed with ambient air is low. Hence, the fuel-air ratio F/A is high at a local portion near the swirl vanes 130A1 to 130A4. As a result, even under a partial load, the amounts of discharge of CO and UHC can be reduced, and highly efficient combustion can be ensured.

Furthermore, the fuel injected from the respective swirl vanes 130A1 to 130A3 rides the swirl air flow a wrapping up toward the inner peripheral side, and burns near the combustion burner 100A. By this burning near the combustion burner 100A, the proportion of the injected fuel diffused by and mixed with ambient air is decreased, and the local fuel-air ratio F/A increases. Even under a partial load, the amounts of discharge of CO and UHC can be reduced, and highly efficient combustion can be ensured.

If the fuel is injected into the swirl air flow a wrapping up toward the outer peripheral side, this fuel flows downstream while spreading toward the outer peripheral side. Then, the fuel is constricted by the burner tube 120 (see FIG. 1), and then combusted. Thus, the position of combustion is remote from the swirl vane 130 in the downstream direction, thus making the fuel apt to be diffused by and mixed with air. This is not advantageous for decreasing the amounts of discharge of CO and UHC, or for ensuring high efficiency combustion.

In the above embodiment, when the load on the gas turbine becomes a partial load, the control section 310 controls the premixed combustion burner 100A such that the valves 300A1 to 300A3 are opened, and their opening is adjusted according to the amount of the load, while the valves 300A4 to 300A6 are closed. However, while the valves 300A1 to 300A3 are opened, and their opening is adjusted according to the amount of the load, the valves 300A4 to 300A6 need not be fully closed, but may be set at a predetermined opening (this opening may be determined beforehand, or may be set according to the load) which is smaller than the opening of the valves 300A1 to 300A3.

When the load is a partial load, the control section 310 exercises the same control, as the above-mentioned control for the premixed combustion burner 100A, over the premixed combustion burners 100B to 100H simultaneously.

That is, in the case of the partial load, the control section 310 controls the premixed combustion burners 100B to 100H such that the valves 300B1 to 300B3, 300C1 to 300C3, 300D1 to 300D3, 300E1 to 300E3, 300F1 to 300F3, 300G1 to 300G3, and 300H1 to 300H3 are opened, their opening is increased or decreased according to the amount of the load, and the remaining valves are closed. By such control, fuel is injected through the injection holes 133*a*, 133*b* of the swirl vanes 130B1 to 130B3, 130C1 to 130C3, 130D1 to 130D3, 130E1 to 130E3, 130F1 to 130F3, 130G1 to 130G3, and 130H1 to 130H3. Here, the swirl vanes 130B1 to 130B3, 130C1 to 130C3, 130D1 to 130D3, 130E1 to 130E3, 130F1 to 130F3, 130G1 to 130G3, and 130H1 to 130H3 are the swirl vanes adjacent parallel in the circumferential direction.

In the premixed combustion burners 100B to 100H, therefore, like the premixed combustion burner 100A, even under a partial load, the local fuel-air ratio F/A is high, the amounts of discharge of CO and UHC can be reduced, and highly efficient combustion can be ensured.

After all, when a partial load is reached, all the premixed combustion burners 100A to 100H, if viewed as the burner as a whole, operates to burn without resting. If attention is paid to the individual premixed combustion burner 100, however, fuel is injected only from some of the plural swirl vanes. Thus, even under a partial load, the local fuel-air ratio F/A is high, the amounts of discharge of CO and UHC can be reduced, and highly efficient combustion can be ensured. Furthermore, the heating value is uniformized with respect to the circumferential direction, and strain force due to thermal stress is not imposed on the transition pipe.

<Modification of Staging Control>

The above-described staging control by the control section 310 is an example and, in the case of a partial load, the number of the swirl vanes arranged adjacently in a group (i.e., the swirl vanes injecting the fuel) can be changed.

Under the partial load, the plurality of swirl vanes 130 injecting the fuel are, according to the above embodiment, a group of the swirl vanes arranged adjacently in the circumferential direction. However, it is possible to inject the fuel from the swirl vanes 130 arranged alternately in the circumferential direction.

In the above embodiment, all the swirl vanes 130 are provided with the injection holes 133*a* and the injection holes 133*b*. However, the swirl vanes 130A1, 130B1, 130C1, 130D1, 130E1, 130F1, 130G1, 130H1 may be provided only with the injection holes 133*a* on the vane ventral side, the swirl vanes 130A2, 130B2, 130C2, 130D2, 130E2, 130F2, 130G2, 130H2 may be provided only with the injection holes 133*a*, 133*b* on the vane ventral side and the vane dorsal side, and the swirl vanes 130A3, 130B3, 130C3, 130D3, 130E3, 130F3, 130G3, 130H3 may be provided only with the injection holes 133*b* on the vane dorsal side. The other swirl vanes 130 are provided with the injection holes 133*a*, 133*b*.

By so doing, under a partial load, fuel injection can be performed concentratedly for particular some of the plurality of air passages 111 (in the premixed combustion burner 100A, for example, the air passage sandwiched between the swirl vane 130A1 and the swirl vane 130A2, and the air passage sandwiched between the swirl vane 130A2 and the swirl vane 130A3), whereby a local fuel-air ratio F/A can be raised.

Furthermore, under a partial load, fuel can be injected only from the specific swirl vanes of the plural swirl vanes, as described above, for the premixed combustion burners 100A, 100C, 100E, 100G, and fuel injection can be stopped completely for the premixed combustion burners 100B, 100D, 100F, 100H.

Embodiment 2

Next, Embodiment 2 of the present invention will be described. An explanation will be omitted for the same constituent parts as in Embodiment 1, and the parts unique to Embodiment 2 will be explained.

In the present Embodiment 2 as well, when a partial load is reached, the plurality of premixed combustion burners 100, if viewed as the burner as a whole, operates to burn without resting. If attention is paid to the individual premixed combustion burner 100, however, fuel is injected only from some of the plural swirl vanes 130.

Figure 10:
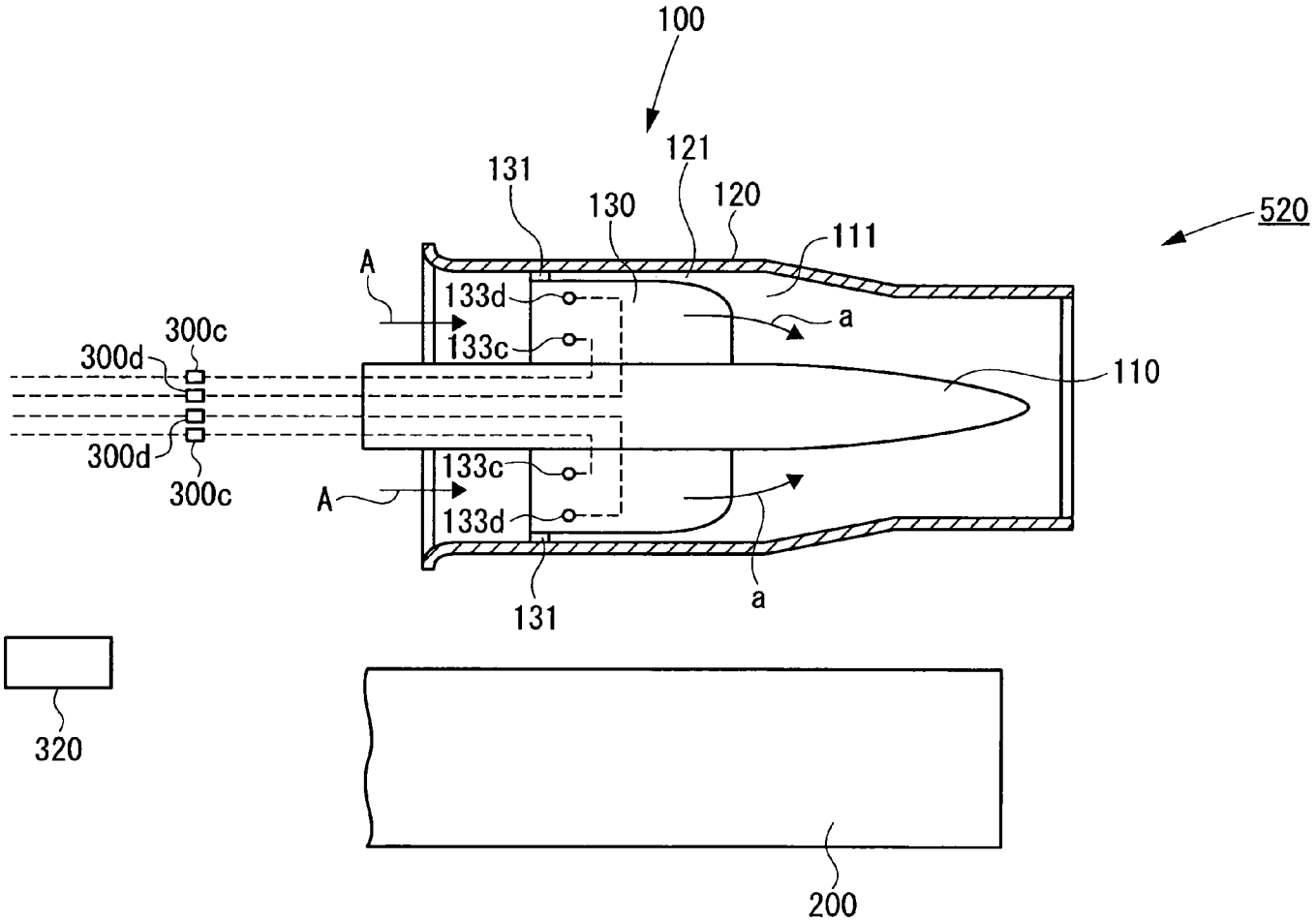
FIG. 10 is a configurational drawing showing the combustor according to Embodiment 2 of the present invention.

In a combustor 520 of Embodiment 2, as shown in FIG. 10, each swirl vane 130 is provided with injection holes 133*c* on the inner peripheral side and injection holes 133*d* on the outer peripheral side. Also, fuel passages (indicated by dashed lines in the drawing) for supplying a fuel individually to the respective injection holes 133*c*, 133*d* are arranged, and valves 300*c*, 300*d* are interposed in the respective fuel passages. A control section 320 controls the valves 300*c*, 300*d* to open or close, exercising staging control. The features of the other portions are the same as those in Embodiment 1.

In Embodiment 2, when the load on the gas turbine is a full load, the control section 320 opens the valves 300*c*, 300*d*, injecting the fuel through the injection holes 133*c*, 133*d*.

When the load on the gas turbine becomes a partial load, the control section 320 closes the valves 300*d* to stop fuel injection through the injection holes 133*d* on the outer peripheral side, and also adjusts the opening of the valves 300*c* in accordance with the amount of the load to adjust the amount of fuel injection through the injection holes 133*c* on the inner peripheral side.

On the inner peripheral side, the circumferential length is short. When a partial load is reached, therefore, the proportion in which the fuel injected through the injection holes 133*c* on the inner peripheral side is diffused by and mixed with ambient air becomes low. In the entire premixed combustion burner 100, the fuel-air ratio F/A is low. In the vicinity of the injection holes 133*c*, however, the fuel-air ratio F/A is high locally. Thus, even under a partial load, the amounts of discharge of CO and UHC can be reduced, and highly efficient combustion can be ensured.

Under the partial load, the fuel may be injected only through the injection holes 133*c* on the inner peripheral side which are provided in a predetermined number of (e.g., three) swirl vanes 130 arranged adjacently in the circumferential direction among the six swirl vanes 130.

Figure 11:
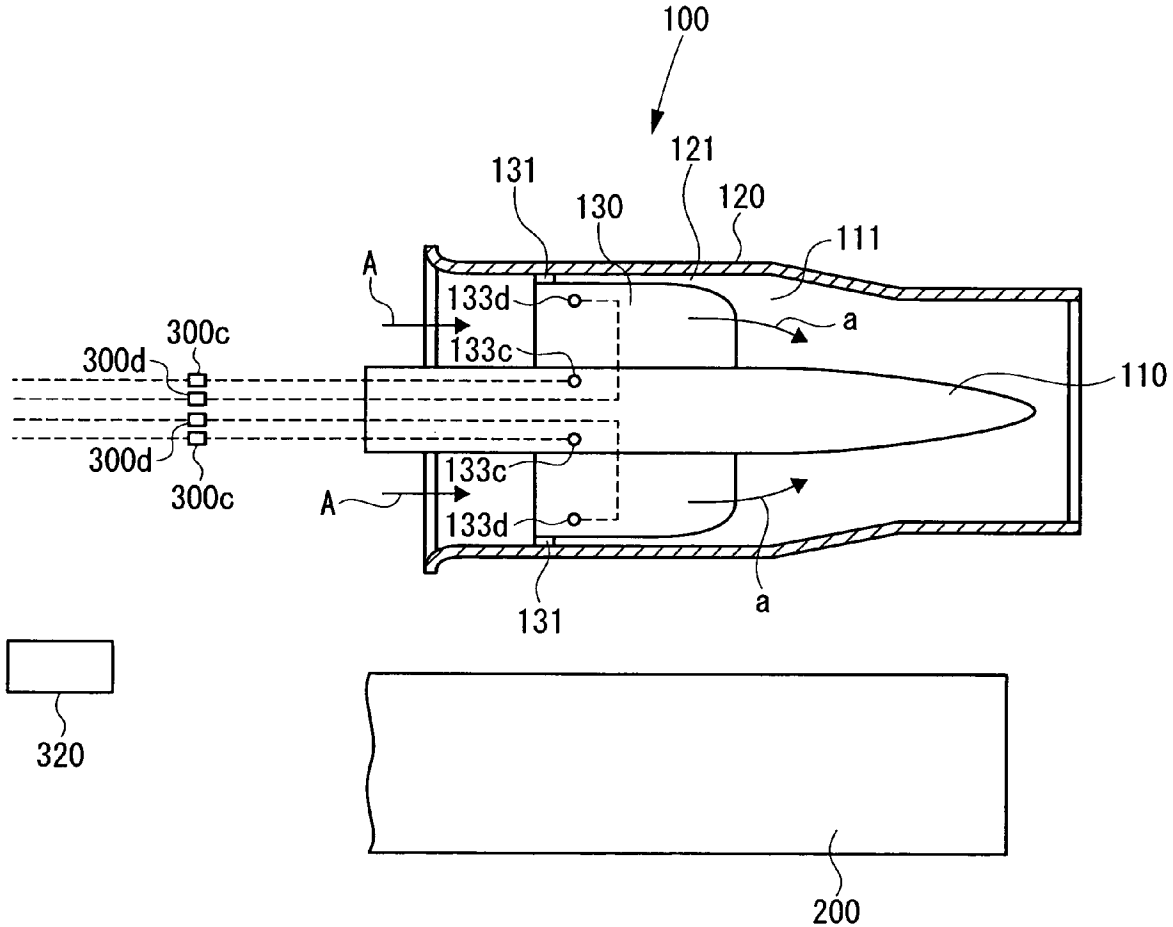
FIG. 11 is a configurational drawing showing a modification of Embodiment 2 of the present invention.
Figure 12:
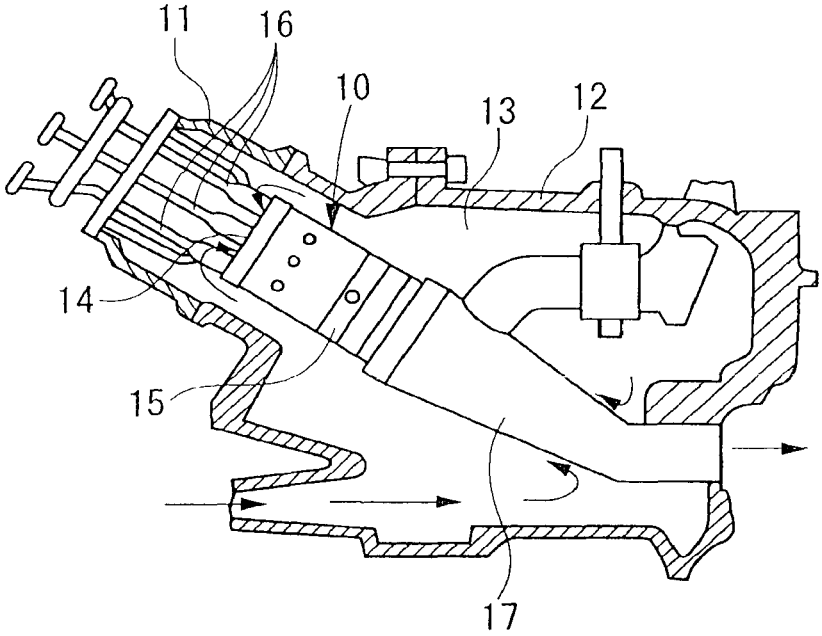
Fig.12 PRIOR ART
FIG. 12 is a configurational drawing showing a combustor of a conventional gas turbine.
Figure 13:
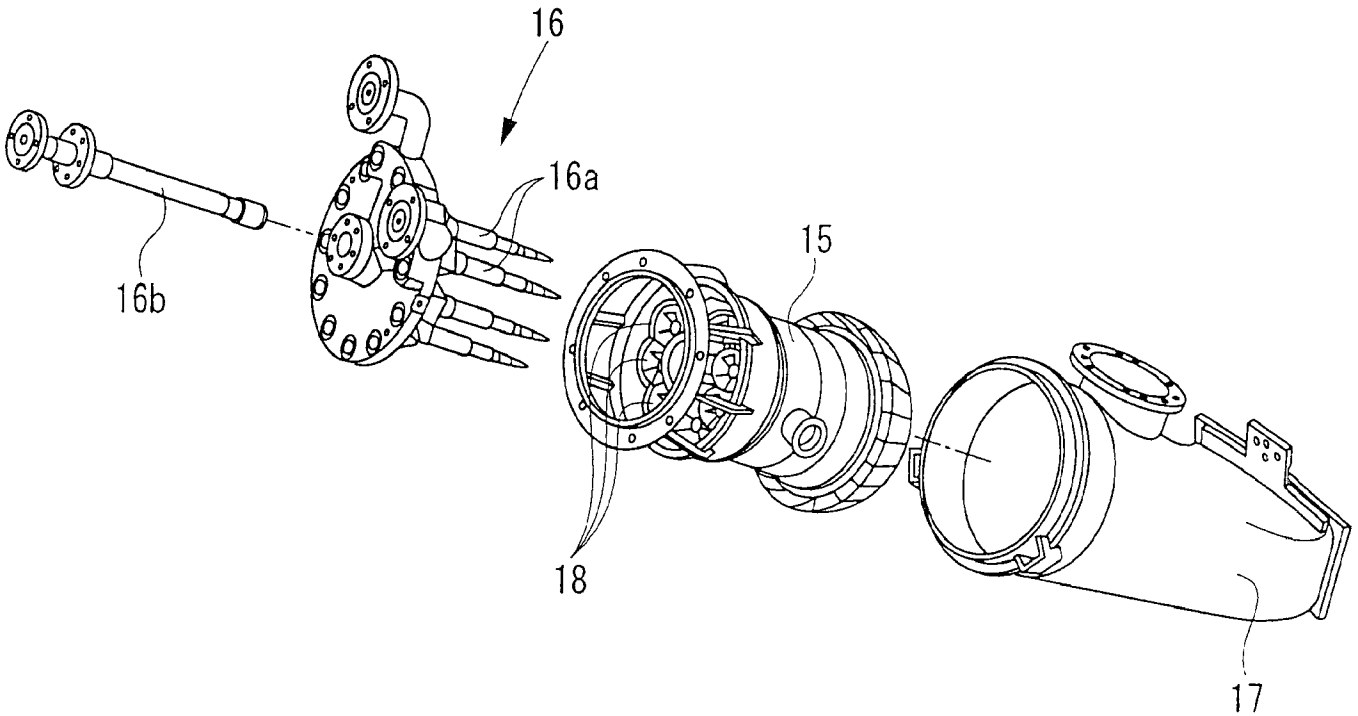
Fig. 13 PRIOR ART
FIG. 13 is a perspective view showing a fuel nozzle, an inner tube, and a transition pipe of the combustor of the conventional gas turbine in an exploded state.

As shown in FIG. 11, moreover, the injection holes 133*c* on the inner peripheral side may be provided not in the swirl vane 130, but in a portion of a fuel nozzle 110 close to the swirl vane 130.

The invention claimed is:

1. A combustor of a gas turbine, the combustor having a combustion burner, comprising:

a fuel nozzle; and swirl vanes which are arranged at a plurality of locations, along a circumferential direction, on an outer peripheral surface of the fuel nozzle in such a state as to extend along an axial direction of the fuel nozzle, said swirl vanes are progressively curved from an upstream side toward a downstream side of a flow of air flowing along the axial direction of the fuel nozzle in order to swirl the air around the fuel nozzle, wherein the combustor comprises:

injection holes, formed at a position on the upstream side of the flow of air on a vane ventral surface and a vane dorsal surface of each swirl vane, for injecting a fuel;

fuel passages for supplying the fuel individually to the injection holes formed in each swirl vane;

valves provided in the respective fuel passages; and a control section for controlling the valves to open or close, and the control section brings all of the valves to an open state when the gas turbine is in a full load state, and controls an opening of the valves, which are provided in the fuel passages for supplying the fuel to the injection holes formed in a specific number of the swirl vanes of the fuel nozzle arranged adjacently as a group in the circumferential direction, in accordance with a load, and closes valves of the remaining swirl vanes of the fuel nozzle, when the gas turbine is in a partial load state.

2. A combustor of a gas turbine, the combustor having a plurality of combustion burners each comprising:

a fuel nozzle; and swirl vanes which are arranged at a plurality of locations, along a circumferential direction, on an outer peripheral surface of the fuel nozzle in such a state as to extend along an axial direction of the fuel nozzle, said swirl vanes are progressively curved from an upstream side toward a downstream side of a flow of air flowing along the axial direction of the fuel nozzle in order to swirl the air around the fuel nozzle, wherein the combustor comprises:

injection holes on an inner peripheral side and injection holes on an outer peripheral side, which are formed on an inner peripheral side and an outer peripheral side of each swirl vane at a position on the upstream side of the flow of air on a vane ventral surface and a vane dorsal surface of each swirl vane, for injecting a fuel;

fuel passages for supplying the fuel individually to the respective injection holes on the inner peripheral side and the respective injection holes on the outer peripheral side formed in each swirl vane;

valves provided in the respective fuel passages; and a control section for controlling the valves to open or close, and the control section exercises control over the plurality of the combustion burners in such a manner as to:

bring all of the valves to an open state when the gas turbine is in a full load state, and control an opening of the valves, which are provided in the fuel passages for supplying the fuel to the injection holes on the inner peripheral side, in accordance with a load, and close the valves provided in the fuel passages for supplying the fuel to the injection holes on the outer peripheral side, when the gas turbine is in a partial load state.

3. A combustor of a gas turbine, the combustor having a plurality of combustion burners each comprising;

a fuel nozzle; and swirl vanes which are arranged at a plurality of locations, along a circumferential direction, on an outer peripheral surface of the fuel nozzle in such a state as to extend along an axial direction of the fuel nozzle, said swirl vanes are progressively curved from an upstream side toward a downstream side of a flow of air flowing along the axial direction of the fuel nozzle in order to swirl the air around the fuel nozzle, wherein the combustor comprises:

injection holes formed in each swirl vane for injecting a fuel;

fuel passages for supplying the fuel individually to the injection holes formed in each swirl vane;

valves provided in the respective fuel passages; and a control section for controlling the valves to open or close, a plurality of the combustion burners being arranged side by side in a circumferential direction, and the control section exercises control over the plurality of the combustion burners in such a manner as to bring all of the valves to an open state when the gas turbine is in a full load state, and control an opening of the valves, which are provided in the fuel passages for supplying the fuel to the injection holes formed in a specific number of the swirl vanes of the fuel nozzle arranged adjacently as a group in the circumferential direction, in accordance with a load, and close valves of the remaining swirl vanes of the fuel nozzle, when the gas turbine is in a partial load state.

controls an opening of the valves, which are provided in the fuel passages for supplying the fuel to the injection holes formed in a specific number of the swirl vanes of the fuel nozzle arranged adjacently as a group in the circumferential direction, in accordance with a load, and closes valves of the remaining swirl vanes of the fuel nozzle, when the gas turbine is in a partial load state.

4. The combustor of a gas turbine according to claim 3, characterized in that the swirl vanes arranged adjacently in the circumferential direction are arranged at portions where a swirl air flow wrapping up toward an inner peripheral side of the combustor flows.

5. A combustor of a gas turbine, the combustor having a plurality of combustion burners each comprising:

a fuel nozzle; and swirl vanes which are arranged at a plurality of locations, along a circumferential direction, on an outer peripheral surface of the fuel nozzle in such a state as to extend along an axial direction of the fuel nozzle, said swirl vanes are progressively curved from an upstream side toward a downstream side of a flow of air flowing along the axial direction of the fuel nozzle in order to swirl the air around the fuel nozzle, wherein the combustor comprises:

injection holes on an inner peripheral side and injection holes on an outer peripheral side which are formed on an inner peripheral side and an outer peripheral side of each swirl vane for injecting a fuel;

fuel passages for supplying the fuel individually to the respective injection holes on the inner peripheral side and the respective injection holes on the outer peripheral side formed in each swirl vane;

valves provided in the respective fuel passages; and a control section for controlling the valves to open or close, a plurality of the combustion burners being arranged side by side in a circumferential direction, and the control section exercises control over the plurality of the combustion burners in such a manner as to bring all of the valves to an open state when the gas turbine is in a full load state, and control an opening of the valves, which are provided in the fuel passages for supplying the fuel to the injection holes on the inner peripheral side, in accordance with a load, and close the valves provided in the fuel passages for supplying the fuel to the injection holes on the outer peripheral side, when the gas turbine is in a partial load state.

6. A combustor of a gas turbine, the combustor having a plurality of combustion burners each comprising:

a fuel nozzle; and swirl vanes which are arranged at a plurality of locations, along a circumferential direction, on an outer peripheral surface of the fuel nozzle in such a state as to extend along an axial direction of the fuel nozzle, said swirl vanes are progressively curved from an upstream side toward a downstream side of a flow of air flowing along the axial direction of the fuel nozzle in order to swirl the air around the fuel nozzle, wherein the combustor comprises:

injection holes formed in each swirl vane for injecting a fuel, and injection holes formed in the fuel nozzle for injecting the fuel;

fuel passages for supplying the fuel individually to the respective injection holes formed in each swirl vane and the respective injection holes formed in the fuel nozzle;

valves provided in the respective fuel passages; and a control section for controlling the valves to open or close, a plurality of the combustion burners being arranged side by side in a circumferential direction, and the control section exercises control over the plurality of the combustion burners in such a manner as to bring all of the valves to an open state when the gas turbine is in a full load state, and control an opening of the valves, which are provided in the fuel passages for supplying the fuel to the injection holes formed in the fuel nozzle, in accordance with a load, and close the valves provided in the fuel passages for supplying the fuel to the injection holes formed in the swirl vanes, when the gas turbine is in a partial load state.

7. The combustor of a gas turbine according to any one of claims 1 to 4, characterized in that an angle formed by a tangent to an average camber line of the swirl vane at a rear edge of the swirl vane and an axis line extending along the axial direction of the fuel nozzle is 0 to 10 degrees on an inner peripheral side of the rear edge of the swirl vane, and the angle is larger on an outer peripheral side of the rear edge of the swirl vane than the angle on the inner peripheral side of the rear edge of the swirl vane.

8. The combustor of a gas turbine according to any one of claims 1 to 4, characterized in that an angle formed by a tangent to an average camber line of the swirl vane at a rear edge of the swirl vane and an axis line extending along the axial direction of the fuel nozzle is 0 to 10 degrees on an inner peripheral side of the rear edge of the swirl vane, and is 25 to 35 degrees on an outer peripheral side of the rear edge of the swirl vane.

* * * * *